US010488876B1

(12) United States Patent
Jackum et al.

(10) Patent No.: US 10,488,876 B1
(45) Date of Patent: Nov. 26, 2019

(54) WIDE RANGE HIGH ACCURACY CURRENT SENSING

(71) Applicant: Dialog Semiconductor (UK) Limited, London (GB)

(72) Inventors: Thomas Jackum, Gleisdorf (AT); Walter Meusburger, Graz (AT)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 16/227,455

(22) Filed: Dec. 20, 2018

(51) Int. Cl.

| | |
|---|---|
| ***G05F 1/565*** | (2006.01) |
| ***G05F 1/59*** | (2006.01) |
| ***G05F 1/575*** | (2006.01) |
| *G05F 1/56* | (2006.01) |

(52) U.S. Cl.
CPC ..... *G05F 1/565* (2013.01); *G05F 1/575* (2013.01); *G05F 1/59* (2013.01); *G05F 1/56* (2013.01); *G05F 1/562* (2013.01)

(58) Field of Classification Search
CPC . G05F 1/565; G05F 1/575; G05F 1/59; G05F 1/562; G05F 1/56; G05F 1/445; G05F 1/468; G05F 1/613
See application file for complete search history.

(56) References Cited

U.S. PATENT DOCUMENTS

| | | | | |
|---|---|---|---|---|
| 6,215,338 | B1 | 4/2001 | Gervasi et al. | |
| 7,183,756 | B1 | 2/2007 | Dikken et al. | |
| 8,089,261 | B2 * | 1/2012 | Lipka | G05F 1/575 323/315 |
| 8,536,844 | B1 * | 9/2013 | Kumar | G05F 1/565 323/269 |
| 8,987,949 | B1 * | 3/2015 | Chui | G05F 1/577 307/155 |
| 9,274,534 | B2 * | 3/2016 | Fang | G05F 1/575 |
| 2012/0038332 | A1 * | 2/2012 | Lin | G05F 1/575 323/277 |
| 2019/0020338 | A1 * | 1/2019 | Chellamuthu | G05F 1/56 |
| 2019/0079552 | A1 * | 3/2019 | Yasusaka | G05F 1/575 |

* cited by examiner

*Primary Examiner* — Kyle J Moody
(74) *Attorney, Agent, or Firm* — Saile Ackerman LLC; Stephen B. Ackerman

(57) ABSTRACT

A circuit and a method using a pass device that is coupled between a supply voltage level and a load-connectable node of the circuit for providing a load current. A sense device forms a current mirror with the pass device. The sense device has transistor devices that can be switched to an active state, to adjust a mirror ratio of the current mirror. A first feedback loop regulates a voltage drop across the pass device to a predetermined value. A second feedback loop regulates a voltage drop across the sense device to the voltage drop across the pass device. Measurement circuitry sets a mirror ratio of the current mirror based on an indication of a current flowing through the sense device and generates an indication of current flowing through the pass device based on the set mirror ratio and the indication of the current flowing through the sense device.

26 Claims, 5 Drawing Sheets

WIDE RANGE HIGH ACCURACY CURRENT SENSING

TECHNICAL FIELD

This disclosure relates to circuits (e.g., switching power converter circuits, DC-DC converters, supply switches, power switches, power distribution circuits, currents sensors) for receiving an input power at an input node and outputting an output power at, e.g., an output node. The disclosure particularly relates to current sensing, especially high-accuracy and wide-range current sensing, in such circuits, and to corresponding methods.

BACKGROUND

For applications that require current sensing over a wide range (e.g., 100 μA-1 A) it is difficult to maintain high accuracy of the sensed current throughout this range.

SUMMARY

Thus, there is a need for improved current sensor circuits that allow for accurate current sensing in a wide range, e.g., over several orders of magnitude. There is further need for corresponding methods of operating such circuits.

In view of some or all of these needs, the present disclosure proposes a circuit including a pass device and a method of sensing a current flowing through a pass device of a circuit, having the features of the respective independent claims.

An aspect of the disclosure relates to a circuit including a pass device that is coupled between a supply voltage level and a load-connectable node of the circuit, for providing a load current at the load-connectable node. The circuit may be an Integrated Circuit (IC) for example. The IC may be a Power management IC (PMIC), for example. The load-connectable node may be referred to as an output node. It may be an IC output pin/ball or may be internal to the IC for on-chip loads. The circuit may further include a sense device that forms a current mirror with the pass device. That is, control terminals of the pass device and the sense device are coupled to each other. The pass device and the sense device may be MOSFETs, such as PMOS or NMOS transistors, for example. In this case, their control terminals could be referred to as gate terminals. The pass device and the sense may also be Bipolar Junction Transistors (BJTs), for example, in which case their control terminals could be referred to as base terminals. The sense device may include a plurality of transistor devices that can be selectively switched to an active state, to thereby adjust a mirror ratio of the current mirror. The plurality of transistor devices may be MOSFETs, such as PMOS or NMOS transistors, for example, or BJTs. The plurality of transistor devices may be coupled in parallel to each other. Each of the plurality of transistor devices can be (individually) switched between an inactive state (off) and the active state (on). The circuit may further include a first feedback loop for regulating a voltage drop across the pass device to a predetermined value by regulating a voltage at a control terminal of the pass device. The circuit may further include a second feedback loop for regulating a voltage drop across the sense device to the voltage drop across the pass device. The second feedback loop may correspond to a voltage drop equalizer, for example. If the pass and sense devices are MOSFETs, the second feedback loop may correspond to a VDS-equalizer. Then, the second feedback loop may regulate a voltage at an output terminal (drain terminal) of the sense device to a voltage at an output terminal (drain terminal) of the pass device. The circuit may yet further include measurement circuitry for setting a mirror ratio of the current mirror based on an indication (measure) of a current flowing through the sense device, and for generating an indication of a current flowing through the pass device based on the set mirror ratio and the indication of the current flowing through the sense device. The measurement circuitry may correspond to or include a digital block/circuit, for example. Setting the mirror ratio of the current mirror may involve switching one or more transistor devices among the plurality of transistor devices between the inactive state and the active state or vice versa. The more transistor devices are switched to the active state, the smaller the mirror ratio.

With the above configuration, the voltage drops across the pass device and the sense device are substantially independent of the load current. Thereby, the circuit imposes reduced offset requirements on the second feedback loop (voltage drop equalizer, e.g., VDS-equalizer). Moreover, the circuit is easily scalable and avoids impedance/voltage jumps when sweeping the load current (i.e., the current flowing through the pass device). Overlapping ranges for the load current can be readily implemented with the circuit. In consequence, the circuit enables accurate current sensing of the load current over a wide range of load currents (e.g., several orders of magnitude).

In some embodiments, input terminals of the plurality of transistor devices may be coupled to the supply voltage level. Output terminals of the plurality of transistor devices may be coupled to each other to form an output terminal of the sense device. Further, each of the plurality of transistor devices can be selectively switched to the active state by coupling a control terminal of that transistor device to the control terminal of the pass device. Conversely, switching a transistor device among the plurality of transistor device from the active state to the inactive state may correspond to disconnecting the control terminal of that transistor device from the control terminal of the pass device. If the transistor devices are PMOS transistors, their input and output terminals may be referred to as source and drain terminals, respectively. On the other hand, if the transistor devices are NMOS transistors, their input and output terminals may be referred to as drain and source terminals, respectively. If the NMOS transistors are used on the lower side of the supply voltage level, their input and output terminals may be referred to as source and drain terminals, respectively. If the transistor devices are BJTs, their input and output terminals may be referred to as emitter and collector terminals, respectively. In general, an input terminal in the context of the disclosure shall denote a terminal at which the load/sense current flows into the device, an output terminal shall denote a terminal at which the load/sense current flows out of the device, and a control terminal shall denote a terminal that controls the resistivity of the device.

By providing this configuration, the mirror ratio of the current mirror can be easily adapted, which allows for efficient adaptation to the actual magnitude of the load current.

In some embodiments, the measurement circuitry may be configured to compare the indication of the current flowing through the sense device to a lower bound for said indication and, if said indication is below the lower bound, adjust the mirror ratio by switching additional transistor devices among the plurality of transistor devices from an inactive state to the active state. Thereby, the mirror ratio is reduced, wherein the mirror ratio is defined as the ratio $I_{switch}/I_{sense}$ of the current $I_{switch}$ flowing through the pass device and the current $I_{sense}$ flowing through the sense device. The comparison may be part of comparing the (indication of the) current flowing through the sense device to a predetermined window. The mirror ratio may be said to be set based on the comparison to the lower bound/predetermined window. The comparison and the setting of the mirror ratio may be performed by a range selector block, for example.

In some embodiments, the measurement circuitry may be configured to compare the indication of the current flowing through the sense device to an upper bound for said indication and, if said indication is above the upper bound, adjust the mirror ratio by switching additional transistor devices among the plurality of transistor devices from the active state to an inactive state. Thereby, the mirror ratio is increased. The comparison may be part of comparing the (indication of the) current flowing through the sense device to a predetermined window. The mirror ratio may be said to be set based on the comparison to the upper bound/predetermined window. The comparison and the setting of the mirror ratio may be performed by a range selector block, for example.

Thereby, a comparison of the sense current to a predetermined (reference) window can be implemented in a simple and efficient manner, which allows for efficient adaptation to the actual magnitude of the load current.

In some embodiments, the measurement circuitry may be configured to generate the indication of the current flowing through the pass device by multiplying the indication of the current flowing through the sense device by the set mirror ratio.

In some embodiments, the measurement circuitry may include an analog to digital converter, ADC, and a digital block coupled to the ADC, for setting the mirror ratio and for generating the indication of the current flowing through the pass device based on the set mirror ratio and the indication of the current flowing through the sense device. Thereby, the measurement circuitry can be implemented in a simple and efficient manner.

In some embodiments, the digital block may include a range selector block for setting the mirror ratio and a multiplier block for generating the indication of the current flowing through the pass device by multiplying the indication of the current flowing through the sense device by the set mirror ratio.

In some embodiments, the first feedback loop may include a first operational amplifier that receives indications of the predetermined voltage and the voltage drop across the pass device at its input ports and that controls a voltage at the control terminal of the pass device.

In some embodiments, one input port of the first operational amplifier may be coupled to the supply voltage level through a reference voltage source that generates the predetermined voltage. The other input port of the first operational amplifier may be coupled to an output terminal of the pass device. Alternatively, one input port of the first operational amplifier may be coupled to the supply voltage level. Then, the other input port of the first operational amplifier may be coupled to an output terminal of the pass device through a reference voltage source that generates the predetermined voltage.

In some embodiments, the first feedback loop may further include a series connection of a second transistor device and a current source coupled between the supply voltage level and ground. The second transistor device may be of the same type as the pass device. The current source may generate a current that equals a predetermined fraction of the maximum load current. Then, one input port of the first operational amplifier may be coupled to an intermediate node between the second transistor device and the current source. The other input port of the first operational amplifier may be coupled to an output terminal of the pass device. Thereby, a process-dependent reference voltage for the voltage drop across the pass device can be implemented.

In some embodiments, the second feedback loop may include a voltage drop equalizer. If the pass and sense devices are MOSFETs, the second feedback loop may include a VDS-equalizer, for example.

In some embodiments, the second feedback circuit may include a second operational amplifier with its input ports respectively coupled to the output terminal of the pass device and the output terminal of the sense device. The second feedback circuit may further include a third transistor device. The third transistor device may be a MOSFET, such as a PMOS or NMOS, for example, or a BJT. An input terminal of the third transistor device may be coupled to the output terminal of the sense device and a control terminal of the third transistor device may be coupled to an output of the second operational amplifier. An output terminal of the third transistor device may be coupled to the measurement circuitry. A current flowing through the third transistor device may serve as the indication of the current flowing through the sense device. This indication may correspond to the sense current itself.

In some embodiments, each of the plurality of transistor devices of the sense device may correspond to a respective slice of the sense device.

Another aspect of the disclosure relates to a method of sensing a current flowing through a pass device of a circuit. The circuit may include the pass device. The pass device may be coupled between a supply voltage level and a load-connectable node of the circuit, for providing a load current at the load-connectable node. The circuit may further include a sense device that forms a current mirror with the pass device. The sense device may include a plurality of transistor devices that can be selectively switched to an active state, to thereby adjust a mirror ratio of the current mirror. The method may include regulating a voltage drop across the pass device to a predetermined value by regulating a voltage at a control terminal of the pass device. The method may further include regulating a voltage drop across the sense device to the voltage drop across the pass device. The method may further include setting a mirror ratio of the current mirror based on an indication of a current flowing through the sense device. The method may yet further include generating an indication of a current flowing through the pass device based on the set mirror ratio and the indication of the current flowing through the sense device.

In some embodiments, input terminals of the plurality of transistor devices may be coupled to the supply voltage level. Output terminals of the plurality of transistor devices may be coupled to each other to form an output terminal of the sense device. Selectively switching a given transistor device among the plurality of transistor devices to the active state may involve coupling a control terminal of the given transistor device to the control terminal of the pass device.

In some embodiments, setting the mirror ratio of the current mirror may involve comparing the indication of the current flowing through the sense device to a lower bound for said indication. Setting the mirror ratio of the current mirror may further involve, if said indication is below the lower bound, adjusting the mirror ratio by switching additional transistor devices among the plurality of transistor devices from an inactive state to the active state.

In some embodiments, setting the mirror ratio of the current mirror may involve comparing the indication of the current flowing through the sense device to an upper bound for said indication. Setting the mirror ratio of the current mirror may further involve, if said indication is above the upper bound, adjusting the mirror ratio by switching additional transistor devices among the plurality of transistor devices from the active state to an inactive state.

In some embodiments, generating the indication of the current flowing through the pass device may involve multiplying the indication of the current flowing through the sense device by the set mirror ratio.

In some embodiments, the method may further include providing an analog to digital converter (ADC) and a digital block coupled to the ADC, for setting the mirror ratio and for generating the indication of the current flowing through the pass device based on the set mirror ratio and the indication of the current flowing through the sense device.

In some embodiments, the method may further include providing a range selector block for setting the mirror ratio. The method may yet further include providing a multiplier block for generating the indication of the current flowing through the pass device by multiplying the indication of the current flowing through the sense device by the set mirror ratio.

In some embodiments, the method may further include providing a first operational amplifier that receives indications of the predetermined voltage and the voltage drop across the pass device at its input ports and that controls a voltage at the control terminal of the pass device.

In some embodiments, the method may further include coupling one input port of the first operational amplifier to the supply voltage level through a reference voltage source that generates the predetermined voltage. The method may yet further include coupling the other input port of the first operational amplifier to an output terminal of the pass device. Alternatively, the method may further include coupling one input port of the first operational amplifier to the supply voltage level. Then, the method may further include coupling the other input port of the first operational amplifier to an output terminal of the pass device through a reference voltage source that generates the predetermined voltage.

In some embodiments, the method may further include providing a series connection of a second transistor device and a current source, and coupling the series connection between the supply voltage level and ground. The method may yet further include coupling one input port of the first operational amplifier to an intermediate node between the second transistor device and the current source, and coupling the other input port of the first operational amplifier to an output terminal of the pass device.

In some embodiments, the method may further include providing a voltage drop equalizer for regulating the voltage drop across the sense device to the voltage drop across the pass device.

In some embodiments, the method may further include providing a second operational amplifier and respectively coupling its input ports to the output terminal of the pass device and the output terminal of the sense device. The method may yet further include providing a third transistor device, coupling an input terminal of the third transistor device to the output terminal of the sense device, and coupling a control terminal of the third transistor device to an output of the second operational amplifier.

In some embodiments, each of the plurality of transistor devices of the sense device may correspond to a respective slice of the sense device.

It will be appreciated that method steps and apparatus features may be interchanged in many ways. In particular, the details of the disclosed method can be implemented as an apparatus (circuit) adapted to execute some or all or the steps of the method, and vice versa, as the skilled person will appreciate. In particular, it is understood that methods according to the disclosure relate to methods of operating the circuits according to the above embodiments and variations thereof, and that respective statements made with regard to the circuits likewise apply to the corresponding methods.

It is also understood that in the present document, the term "couple" or "coupled" refers to elements being in electrical communication with each other, whether directly connected e.g., via wires, or in some other manner (e.g., indirectly). Notably, one example of being coupled is being connected.

BRIEF DESCRIPTION OF THE DRAWINGS

Example embodiments of the disclosure are explained below with reference to the accompanying drawings, wherein like reference numbers indicate like or similar elements, and wherein FIG. 1 to FIG. 4 schematically illustrate examples of a circuit with a pass device and a sense device according to embodiments of the disclosure.

DESCRIPTION

As indicated above, identical or like reference numbers in the disclosure indicate identical or like elements, and repeated description thereof may be omitted for reasons of conciseness.

One approach for improving the accuracy of current sensing over an extended/wide load current range in a current sensor including a power device/power FET (as an example of a pass device) is to switch fractions/slices of the power FET depending on the load current in order to maintain a sufficient voltage drop across the power device. The reason is that the voltage drop across the power device must not fall into the order of magnitude of the offset of the sense amplifier (e.g., included in a VDS-equalizer).

One disadvantage of this approach is that voltage/impedance steps can occur when switching the slices of the power device. Another disadvantage lies in the difficulty in providing scalability for very wide ranges of the load current (e.g., 100 μA-1 A) while maintaining accuracy. Moreover, the offset requirements on the VDS-equalizer are very high (e.g. <100 μV offset).

Broadly speaking, circuits and methods according to the present disclosure involve three major concepts: regulating the voltage drop across the pass device, applying VDS-equalization between the pass device and the sense device, and comparing the sense current to a reference window and selecting a proper sense ratio (mirror ratio) depending on whether the actual sense current is above, within, or below the reference window.

Figure 1:
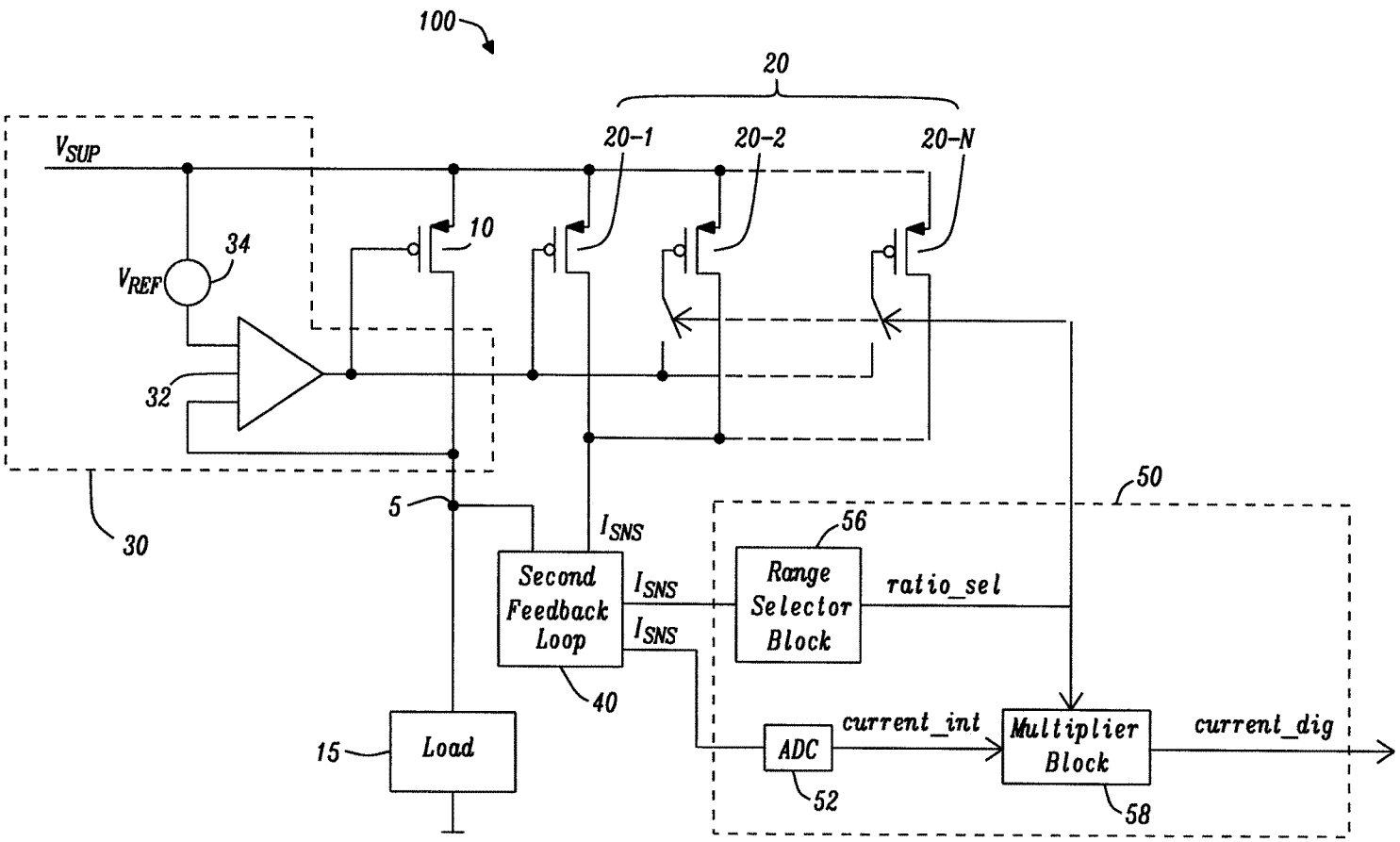

An example of a circuit 100 according to embodiments of the disclosure is schematically illustrated in FIG. 1. The circuit 100 may be referred to as a power switch, for example. Further, the circuit may be implemented as an Integrated Circuit (IC) such as a Power Management Integrated Circuit (PMIC), for example.

The circuit 100 comprises a pass device 10 (power device) that is coupled between a supply voltage level $V_{SUP}$ and a load-connectable node 5. A load 15 may be connected to the load-connectable node 5. The load-connectable node 5 may also be referred to as an output node. If the circuit 100 is implemented as an IC, the load-connectable node 5 may be an IC output pin/ball, but the load-connectable node 5 may also be internal to the IC for on-chip loads.

A voltage drop across the pass device 10 is regulated to a predetermined value (e.g., a reference voltage $V_{REF}$) by a first feedback loop 30 that regulates a voltage at a control terminal of the pass device 10. For example, the pass device 10 can be designed to meet the max VDS drop specification. Then, the reference voltage $V_{REF}$ can be set to be equal to this max VDS drop specification.

The circuit 100 further comprises a sense device 20 for sensing a current $I_{switch}$ that flows through the pass device 10. The sense device 20 is coupled to form a current mirror with the pass device 10. That is, a control terminal of the sense device 20 is coupled to the control terminal of the pass device 10.

The sense device 20 comprises a plurality of transistor devices 20-*i*, i=1, . . . , N. The plurality of transistor devices 20-*i* may correspond to respective slices of the sense device 20. The plurality of transistor devices 20-*i* are coupled in parallel to each other. Input terminals of the plurality of transistor devices 20-*i* are coupled to the supply voltage level $V_{SUP}$ and output terminals of the plurality of transistor devices are coupled to each other to form an output terminal of the sense device 20. Each of the plurality of transistor devices 20-*i* can be selectively (individually) switched between an active state (on) and an inactive state (off). In particular, each of the plurality of transistor devices 20-*i* can be selectively switched to the active state by coupling a control terminal of that transistor device to the control terminal of the pass device 10. To this end, a respective controllable switch may be provided for each transistor device 20-*i*, coupled between the control terminal of that transistor device 20-*i* and the control terminal of the pass device 10, for switchably connecting the control terminals.

The pass device 10 and the sense device 20 (and hence, each of the plurality of transistor devices 20-*i*) as well as any other transistor devices mentioned in this disclosure may be MOSFETs, such as PMOS or NMOS transistors, for example. In this case, their control terminals could be referred to as gate terminals. The pass device and the sense device may also be Bipolar Junction transistors (BJTs) for example, in which case their control terminals could be referred to as base terminals. If the transistors (transistor devices) are PMOS transistors, their input and output terminals may be referred to as source and drain terminals, respectively. On the other hand, if the transistors (transistor devices) are NMOS transistors, their input and output terminals may be referred to as drain and source terminals, respectively. If the NMOS transistors are used on the lower side of the supply voltage level $V_{SUP}$, their input and output terminals may be referred to as source and drain terminals, respectively. If the transistors (transistor devices) are BJTs, their input and output terminals may be referred to as emitter and collector terminals, respectively. In general, an input terminal in the context of the disclosure shall denote a terminal at which the load/sense current flows into the device, an output terminal shall denote a terminal at which the load/sense current flows out of the device, and a control terminal shall denote a terminal that controls the resistivity of the device.

A voltage drop across the sense device 20 is regulated to be equal to the voltage drop across the pass device 10 by a second feedback loop 40. The second feedback loop 40 may comprise (or correspond to) a voltage drop equalizer, for example. If the pass and sense devices 10, 20 are MOSFETs, the second feedback loop 40 may comprise (or correspond to) a VDS-equalizer. Then, the second feedback loop 40 may regulate a voltage at the output terminal (e.g., drain terminal) of the sense device 20 to a voltage at an output terminal (drain terminal) of the pass device 10.

With the voltage drop (e.g., VDS voltage drop) across the pass device 10 fixed, it is easier to design a second feedback loop 40 that equalizes the voltage drop across the sense device 20 (i.e., across each of the active transistor devices 20-*i*) and the pass device 10. The reason is that the offset of the second feedback loop 40 (e.g., of a (second) operational amplifier included in the second feedback loop 40) is only restricted by the (e.g., constantly high) voltage drop across the pass device 10 (e.g., equal to the reference voltage $V_{REF}$).

As regards efficiency, it is to be noted that the worst case power dissipation of the regulated pass device 10 (power device) is still approximately the same compared to a fully turned-on pass device.

It is also to be noted that first feedback loop 30 (e.g., a (first) operational amplifier thereof) does not have high requirements on accuracy, but only needs to be fast enough to quickly turn on the pass device 10 in case of a sudden load current jump. For the first feedback loop 30, several design techniques used in Low Dropout Regulators (LDOs) can be applied, since the structure of the first feedback loop 30 in combination with the pass device 10 is similar to an LDO, except that it operates mainly in the linear region instead of in saturation.

The second feedback loop 40 should fulfil the speed requirement of the current sensing. Nevertheless, it has looser requirements on accuracy compared to a conventional current sensing where the voltage drop across the pass device can vary over a wide range. In the proposed architecture one may always have the maximum possible VDS voltage drop, for example.

The output of the second feedback loop 40 may be an indication $I_{SNS}$ of a current $I_{sense}$ flowing through the sense device 20 (e.g., the current $I_{sense}$ flowing through the sense device 20). This indication $I_{SNS}$ (current) can be mirrored to have it available multiple times. In some implementations, the indication $I_{SNS}$ may be the current $I_{sense}$ itself.

As noted above, the plurality of transistor devices 20-*i* of the sense device 20 can be individually switched between the inactive state (off) and the active state (on). By selectively switching individual ones among the plurality of transistor devices to the active state (i.e., between the active state and the inactive state), the mirror ratio of the current mirror (formed by the pass device 10 and the sense device 20) can be adjusted. The mirror ratio is defined as the ratio $I_{switch}/I_{sense}$ of the current $I_{switch}$ that flows through the pass device 10 and the current $I_{sense}$ that flows through the sense device 20. The more transistor devices 20-*i* are switched to the active state, the smaller the mirror ratio. Accordingly, switching additional transistor devices among the plurality of transistor devices 20-*i* from the inactive state to the active state will reduce the mirror ratio. On the other hand, switching additional transistor devices among the plurality of transistor devices 20-*i* from the active state to the inactive state will increase the mirror ratio.

Referring again to FIG. 1, the circuit 100 further comprises measurement circuitry 50, which may correspond to a digital block/circuit, for example. The measurement circuitry 50 receives the indication $I_{SNS}$ of the current $I_{sense}$ flowing through the sense device 20. The measurement circuit 50 processes the indication of the current $I_{sense}$ flowing through the sense device 20 and sets the mirror ratio of the current mirror based on said indication. Further, the measurement circuitry 50 generates an indication of the current $I_{switch}$ flowing through the pass device 10 based on the set mirror ratio and the indication $I_{SNS}$ of the current $I_{sense}$ flowing through the sense device 20. For example, the measurement circuitry 50 may generate the indication of the current $I_{switch}$ flowing through the pass device 10 by multiplying the indication of the current $I_{sense}$ flowing through the switch device 20 by the set mirror ratio. The indication of the current $I_{switch}$ flowing through the pass device 10 may be a digital value. In some cases, said indication may be the same as an indication of a desired mirror ratio of the current mirror.

Setting the mirror ratio of the current mirror based on the indication $I_{SNS}$ of the current $I_{sense}$ flowing through the sense device 20 may proceed as follows. The measurement circuitry 50 compares the indication of the current $I_{sense}$ flowing through the sense device 20 to a predetermined (reference) window for said indication. The mirror ratio then is set based on the comparison to the predetermined window. If the indication is not within the predetermined window, the mirror ratio of the current mirror is adjusted so that the indication is made to fall into the predetermined window again. The predetermined window can be said to be defined by a lower bound for the indication of the current $I_{sense}$ flowing through the sense device 20 and an upper bound for the indication. Then, comparing the indication to the predetermined window may be said to include comparing the indication to the lower bound and/or the upper bound. If the indication is found to be below the lower bound, the measurement circuitry 50 adjusts the mirror ratio by switching additional transistor devices 20-*i* among the plurality of transistor devices from an inactive state to the active state. Thereby, the mirror ratio is reduced (and the sense current $I_{sense}$ is correspondingly increased). If on the other hand the indication is above the upper bound, the measurement circuitry 50 adjusts the mirror ratio by switching additional transistor devices 20-*i* among the plurality of transistor devices from the active state to an inactive state. Thereby, the mirror ratio is increased (and the sense current $I_{sense}$ is correspondingly reduced).

Next, possible implementations of the measurement circuitry 50 and the first and second feedback loops 30, 40 will be described with further reference to FIG. 1 and reference to FIG. 2 to FIG. 4. These possible implementations may be arbitrarily combined with each other.

In the example of FIG. 1, the measurement circuitry 50 comprises an analog-to-digital converter (ADC) 52, an (automatic) range selector block 56, and a multiplier block 58.

The range selector block 56 sets the mirror ratio of the current mirror. To this end, the range selector block 56 may perform the comparison of the indication $I_{SNS}$ of the current $I_{sense}$ flowing through the sense device 20 to the predetermined window (e.g., to the upper bound and/or the lower bound). The range selector block 56 may output a control signal ratio_sel for the plurality of transistor devices 20-*i* of the sense device 20. The transistor devices 20-*i* of the sense device 20 may be selectively switched to the active state or the inactive state under control of the control signal ratio_sel. For example, the control signal ratio_sel may control which control terminals of the plurality of transistor devices 20-*i* of the sense device 20 are connected to the control terminal of the pass device 10. To this end, each of the control terminals of the transistor devices 20-*i* may be coupled to the control terminal of the pass device 10 through a respective (controllable) switch. These switches may open (off) and close (on) under control of the control signal ratio_sel.

The ADC 52 converts the indication of the current $I_{sense}$ flowing through the sense device 20 to a digital value current_int. The multiplier block 58 generates an indication of the current $I_{switch}$ flowing through the pass device 10 by multiplying the digital value current_int by the set mirror ratio (the mirror ratio being represented, e.g., by the control signal ratio_sel). To this end, the range selector block 56 may provide the control signal ratio_sel also to the multiplier block 58. The indication of the current $I_{switch}$ flowing through the pass device 10 is output as a digital signal current_dig.

To summarize, the indication $I_{SNS}$ is evaluated in an automatic range selector to check whether it is inside a certain (predetermined) window. If the indication/sense current is too low or too high then the current sense ratio (mirror ratio) between the pass device (power device) 10 and the sense device 20 is adjusted. This is done by changing the number of transistor devices 20-*i* connected to the second feedback loop 40 (e.g., VDS-equalizer). This might need several iterations, for instance if the load current jumps suddenly from zero to the maximum load current. The automatic range selector can be implemented as a window comparator or low resolution ADC, for example. Additionally, the indication/sense current is sent to a (high resolution) ADC. The output of this ADC is multiplied by the actual sense ratio to obtain the actual sense current (digital signal current_dig).

Further in the example of FIG. 1, the first feedback loop 30 comprises a first operational amplifier 32 that receives indications of the predetermined voltage and the voltage drop across the pass device 10 at its input ports. The output of the first operational amplifier 32 is coupled to the control terminal of the pass device 10. Thus, the first operational amplifier 32 controls a voltage at the control terminal of the pass device 10, and thereby, controls the pass device 10. The first feedback loop 30 further comprises a reference voltage source 34 that generates the predetermined voltage (reference voltage $V_{REF}$). The reference voltage source 34 can be coupled either between one of the input ports of the first operational amplifier 32 and the supply voltage level $V_{SUP}$, in which case the other input port of the first operational amplifier 32 is coupled (directly) to the output terminal of the pass device 10, or between the other one of the input ports of the first operational amplifier 32 and the output terminal of the pass device 10, in which case the one of the input ports of the first operational amplifier 32 is coupled (directly) to the supply voltage level $V_{SUP}$.

Figure 2:
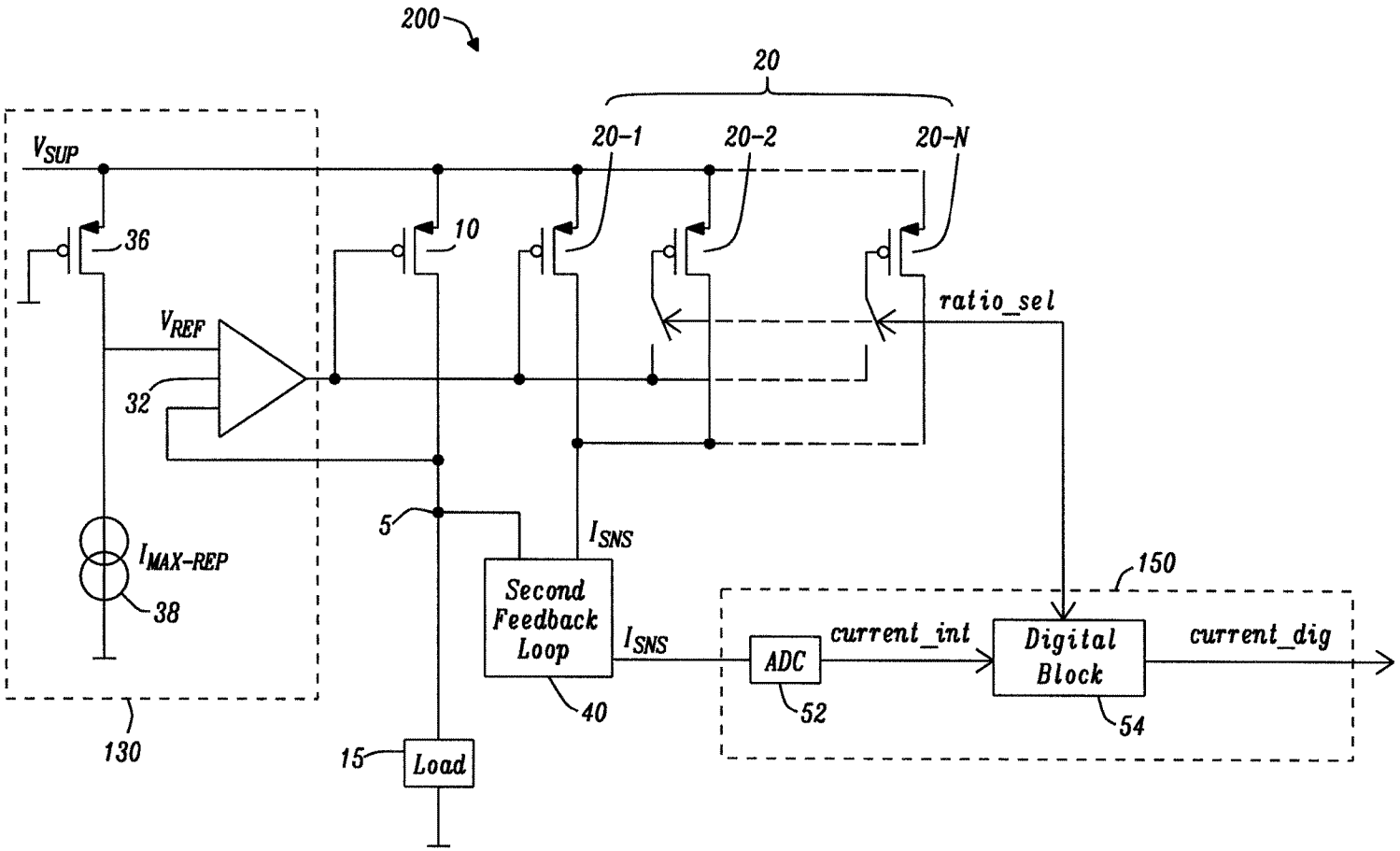

FIG. 2 illustrates an example of another circuit 200 according to embodiments of the disclosure. The circuit 200 differs from the circuit 100 in the implementation of the first feedback loop and the implementation of the measurement circuitry. Otherwise, the circuit 200 is identical to circuit 100 described above and corresponding statements apply.

In the example of FIG. 2, instead of using a dedicated range selector (window comparator/low res ADC) it is possible to use only a main ADC and decide in the digital core to repeat the ADC measurement in case the conversion result exceeds a lower or upper threshold. In case one threshold is exceeded the range selection (mirror ratio) is adjusted according to the exceeded threshold. The ADC result is only valid once the result is inside the two thresholds.

In the circuit 200, the measurement circuitry 150 comprises an ADC 52 and a digital block 54 coupled to the ADC 52. The digital block 54 may be formed by or at least perform the functionalities of the range selector block 56 and the multiplier block 58 described above. That is, the digital block 54 sets the mirror ratio based on the (digitized) indication of the current $I_{sense}$ flowing through the sense device 20 (current_int) and generates the indication of the current $I_{switch}$ flowing through the pass device 10 (current_dig) based on the set mirror ratio and the (digitized) indication of the current $I_{sense}$ flowing through the sense device 20.

The first feedback loop 130 of the circuit 200 uses a variable (process-dependent) voltage as a reference. This variable voltage can be obtained by forcing a (predetermined) current through a replica device of the pass device (power device) 10. This current could be set to a value that corresponds to the supported load current divided by the ratio between the pass device 10 and the replica device. In an implementation of this concept, the first feedback loop 130 comprises a series connection of a second transistor device 36 (implementing the replica device) and a current source 38 coupled between the supply voltage level $V_{SUP}$ and ground. The second transistor device 36 may be of the same type as the pass device 10. The current source 38 generates the predetermined current. For example, the current source 38 may generate a current that equals a predetermined fraction of the maximum load current. This fraction may be given by the ratio between the pass device 10 and the second transistor device 36. In this configuration, one input port of the first operational amplifier 32 is coupled to an intermediate node between the second transistor device 36 and the current source 38, and the other input port of the first operational amplifier 32 is coupled to the output terminal of the pass device 10.

Figure 3:
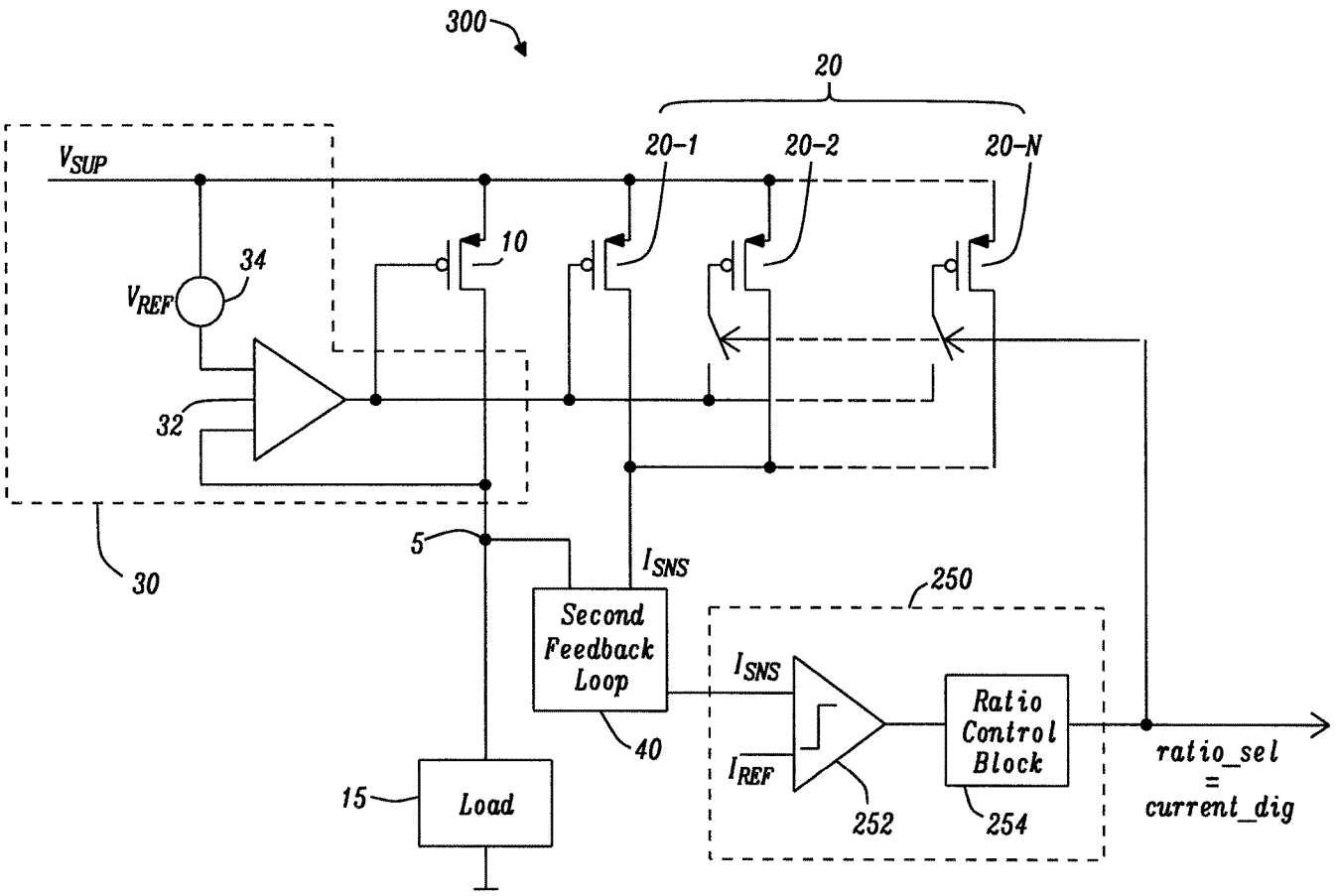

FIG. 3 illustrates an example of another circuit 300 according to embodiments of the disclosure. The circuit 300 differs from the circuit 100 in the implementation of the measurement circuitry. Otherwise, the circuit 300 is identical to circuit 100 described above and corresponding statements apply.

In the circuit 300, the measurement circuitry 250 comprises an analog comparator 252 for comparing the indication $I_{SNS}$ of the current $I_{sense}$ flowing through the sense device 20 to an upper/lower threshold (implemented by a reference current $I_{REF}$). The measurement circuitry 250 further comprises a ratio control block 254 that adjusts the mirror ratio based on a result of the comparison by the comparator 252. In this case, the current mirror may be a programmable current mirror. The control signal ratio_sel in this implementation also serves as the indication current_dig of the current $I_{switch}$ flowing through the pass device 10.

Figure 4:
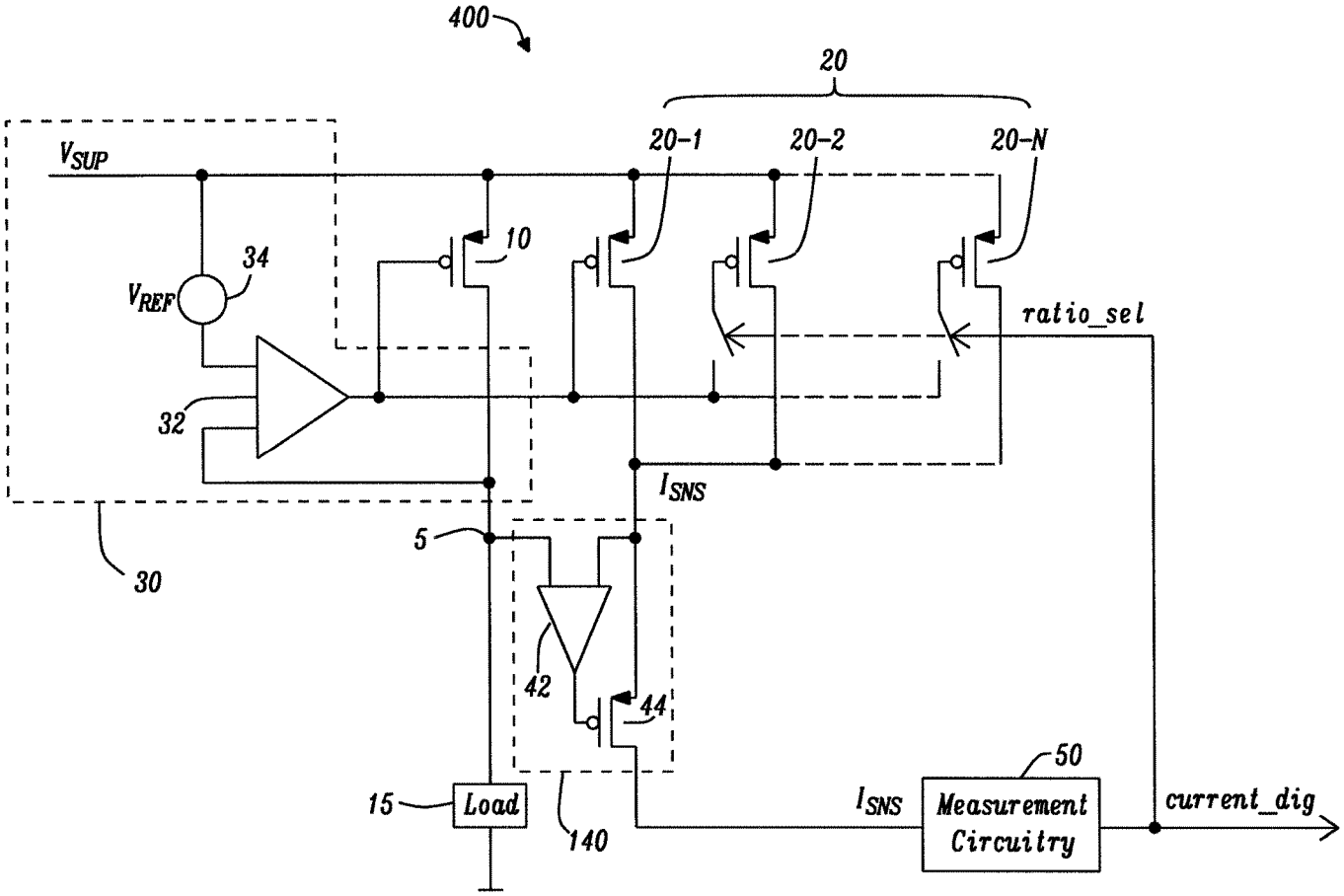

FIG. 4 illustrates an example of another circuit 400 according to embodiments of the disclosure. The circuit 400 differs from the circuit 100 in the implementation of the second feedback loop. Otherwise, the circuit 400 is identical to circuit 100 described above and corresponding statements apply.

In the circuit 400, the second feedback circuit 140 comprises a second operational amplifier 42. The input ports of the second operational amplifier 42 are respectively coupled to the output terminal of the pass device 10 and the output terminal of the sense device 20. The second feedback loop 140 further comprises a third transistor device 44. The third transistor device may be a MOSFET, such as a PMOS or NMOS, for example, or a BJT. An input terminal of the third transistor device 44 is coupled to the output terminal of the sense device 20, and a control terminal of the third transistor device 44 is coupled to an output of the second operational amplifier 42. An output terminal of the third transistor device 44 may be coupled to the measurement circuitry 50. A current flowing through the third transistor device 44 may serve as the indication of the current $I_{sense}$ flowing through the sense device 20. In this manner, the second feedback loop 40 implements a voltage drop equalizer (e.g., VDS-equalizer).

Notably, as indicated above, the implementations of the first and second feedback loops 30, 40 and of the measurement circuitry 50 may be combined with each other in arbitrary manner. That is, each of the possible implementations may be used in each of the above-described circuits 100, 200, 300, 400.

The present disclosure further relates to corresponding methods of sensing a current flowing through a pass device of the circuit. These methods may include providing some, any, or all of the elements of the circuits described above, and/or method steps corresponding to the functionalities of the elements of the circuits described above.

Figure 5:
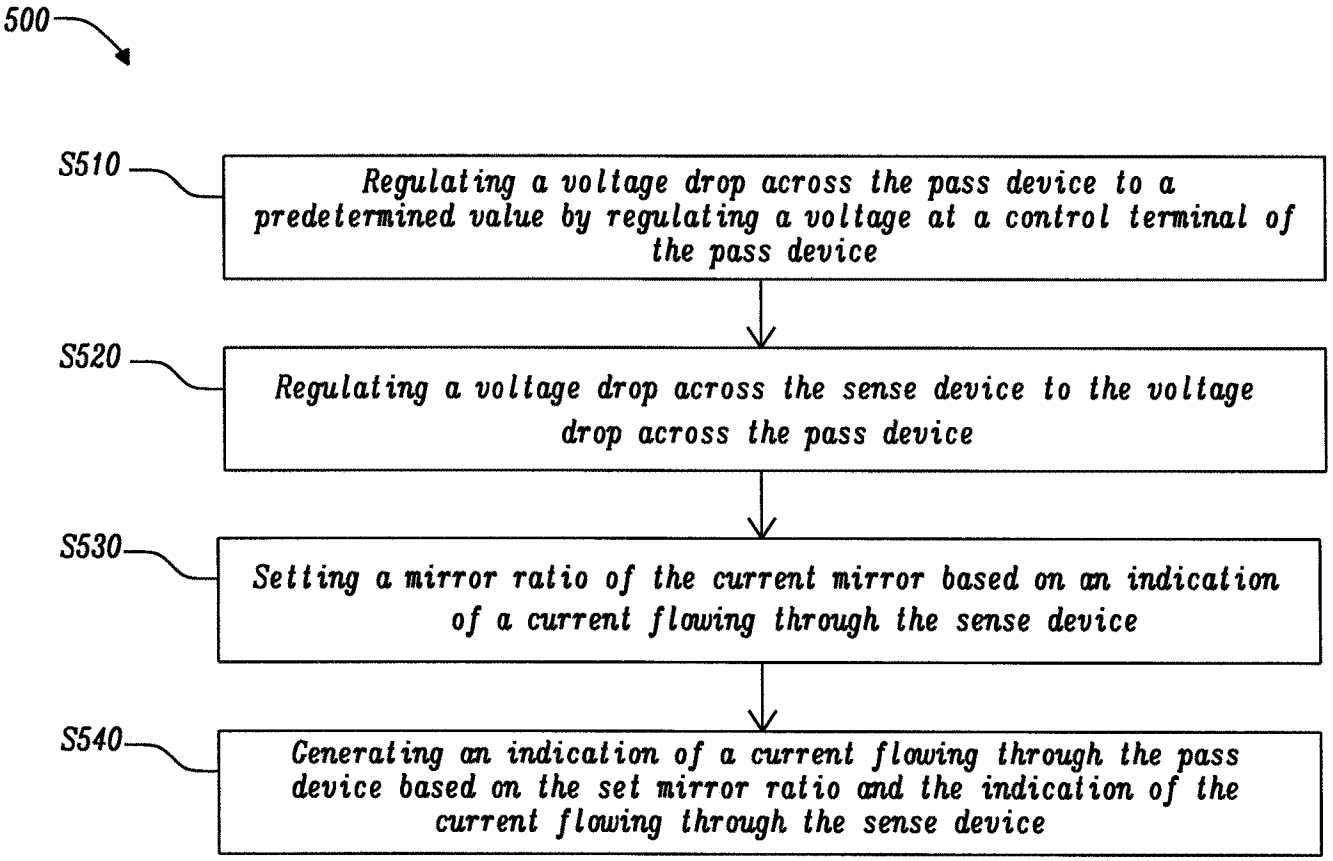
FIG. 5 is a flowchart schematically illustrating a method of sensing a current flowing through a pass device of a circuit according to embodiments of the disclosure.

FIG. 5 is a flowchart schematically illustrating a method 500 of sensing a current flowing through a pass device of a circuit according to embodiments of the disclosure. The circuit may correspond to any one of the circuits described above (e.g., circuits 100, 200, 300, 400). The method 500 comprises, at step S510, regulating a voltage drop across the pass device to a predetermined value by regulating a voltage at a control terminal of the pass device. The method 500 further comprises, at step S520, regulating a voltage drop across the sense device to the voltage drop across the pass device. The method 500 further comprises, at step S530, setting a mirror ratio of the current mirror based on an indication of a current flowing through the sense device. Finally, the method 500 comprises, at step S540, generating an indication of a current flowing through the pass device based on the set mirror ratio and the indication of the current flowing through the sense device.

Simulation results show that the sense current $I_{sense}$ can be kept inside a limited window when sweeping the load current. For a quick load jump the sense current cannot follow immediately but settles to the proper range after moving through the ranges from minimum to maximum.

It should further be noted that the description and drawings merely illustrate the principles of the proposed circuits and methods. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed method. Furthermore, all statements herein providing principles, aspects, and embodiments of the invention, as well as specific examples thereof, are intended to encompass equivalents thereof.

What is claimed is:

1. A circuit comprising:

a pass device that is coupled between a supply voltage level and a load-connectable node of the circuit for providing a load current at the load-connectable node;

a sense device that forms a current mirror with the pass device, wherein the sense device comprises a plurality of transistor devices that can be selectively switched to an active state, to thereby adjust a mirror ratio of the current mirror;

a first feedback loop for regulating a voltage drop across the pass device to a predetermined value by regulating a voltage at a control terminal of the pass device;

a second feedback loop for regulating a voltage drop across the sense device to be equal to the voltage drop across the pass device; and measurement circuitry for setting the mirror ratio of the current mirror based on an indication of a current flowing through the sense device, and for generating an indication of a current flowing through the pass device based on the set mirror ratio set by the measurement circuitry and the indication of the current flowing through the sense device.

2. The circuit according to claim 1, wherein input terminals of the plurality of transistor devices are coupled to the supply voltage level and output terminals of the plurality of transistor devices are coupled to each other to form an output terminal of the sense device; and wherein each of the plurality of transistor devices can be selectively switched to the active state by coupling a control terminal of that transistor device to the control terminal of the pass device.

3. The circuit according to claim 1, wherein the measurement circuitry is configured to compare the indication of the current flowing through the sense device to a lower bound for said indication and, if said indication is below the lower bound, adjust the mirror ratio by switching additional transistor devices among the plurality of transistor devices from an inactive state to the active state.

4. The circuit according to claim 1, wherein the measurement circuitry is configured to compare the indication of the current flowing through the sense device to an upper bound for said indication and, if said indication is above the upper bound, adjust the mirror ratio by switching additional transistor devices among the plurality of transistor devices from the active state to an inactive state.

5. The circuit according to claim 1, wherein the measurement circuitry is configured to generate the indication of the current flowing through the pass device by multiplying the indication of the current flowing through the sense device by the set mirror ratio.

6. The circuit according to claim 1, wherein the measurement circuitry comprises an analog to digital converter, ADC, and a digital block coupled to the ADC, for setting the mirror ratio and for generating the indication of the current flowing through the pass device based on the set mirror ratio and the indication of the current flowing through the sense device.

7. The circuit according to claim 6, wherein the digital block comprises a range selector block for setting the mirror ratio and a multiplier block for generating the indication of the current flowing through the pass device by multiplying the indication of the current flowing through the sense device by the set mirror ratio.

8. The circuit according to claim 1, wherein the first feedback loop comprises a first operational amplifier that receives indications of the predetermined voltage and the voltage drop across the pass device at its input ports and that controls a voltage at the control terminal of the pass device.

9. The circuit according to claim 8, wherein one input port of the first operational amplifier is coupled to the supply voltage level through a reference voltage source that generates the predetermined voltage, and the other a second input port of the first operational amplifier is coupled to an output terminal of the pass device; or wherein the one input port of the first operational amplifier is coupled to the supply voltage level, and the second input port of the first operational amplifier is coupled to an output terminal of the pass device through a reference voltage source that generates the predetermined voltage.

10. The circuit according to claim 8, wherein the first feedback loop further comprises a series connection of a second transistor device and a current source coupled between the supply voltage level and ground; and wherein one input port of the first operational amplifier is coupled to an intermediate node between the second transistor device and the current source, and the other input port of the first operational amplifier is coupled to an output terminal of the pass device.

11. The circuit according to claim 1, wherein the second feedback loop comprises a voltage drop equalizer.

12. The circuit according to claim 1, wherein the second feedback circuit comprises:

a second operational amplifier with its input ports respectively coupled to an output terminal of the pass device and an output terminal of the sense device; and a third transistor device, wherein an input terminal of the third transistor device is coupled to the output terminal of the sense device and a control terminal of the third transistor device is coupled to an output of the second operational amplifier.

13. The circuit according to claim 1, wherein each of the plurality of transistor devices of the sense device corresponds to a respective slice of the sense device.

14. A method of sensing a current flowing through a pass device of a circuit, wherein the circuit comprises:

the pass device, coupled between a supply voltage level and a load-connectable node of the circuit for providing a load current at the load-connectable node; and a sense device that forms a current mirror with the pass device, wherein the sense device comprises a plurality of transistor devices that can be selectively switched to an active state, to thereby adjust a mirror ratio of the current mirror, the method comprising:

regulating a voltage drop across the pass device to a predetermined value by regulating a voltage at a control terminal of the pass device;

regulating a voltage drop across the sense device to be equal to the voltage drop across the pass device;

setting the mirror ratio of the current mirror based on an indication of a current flowing through the sense device; and generating an indication of a current flowing through the pass device based on the mirror ratio set in the step setting the mirror ratio of the current mirror and the indication of the current flowing through the sense device.

15. The method according to claim 14, wherein input terminals of the plurality of transistor devices are coupled to the supply voltage level and output terminals of the plurality of transistor devices are coupled to each other to form an output terminal of the sense device; and wherein selectively switching a given transistor device among the plurality of transistor devices to the active state involves coupling a control terminal of the given transistor device to the control terminal of the pass device.

16. The method according to claim 14, wherein setting the mirror ratio of the current mirror involves comparing the indication of the current flowing through the sense device to a lower bound for said indication and, if said indication is below the lower bound, adjusting the mirror ratio by switching additional transistor devices among the plurality of transistor devices from an inactive state to the active state.

17. The method according to claim 14, wherein setting the mirror ratio of the current mirror involves comparing the indication of the current flowing through the sense device to an upper bound for said indication and, if said indication is above the upper bound, adjusting the mirror ratio by switching additional transistor devices among the plurality of transistor devices from the active state to an inactive state.

18. The method according to claim 14, wherein generating the indication of the current flowing through the pass device involves multiplying the indication of the current flowing through the sense device by the set mirror ratio.

19. The method according to claim 14, further comprising providing an analog to digital converter, ADC, and a digital block coupled to the ADC, for setting the mirror ratio and for generating the indication of the current flowing through the pass device based on the set mirror ratio and the indication of the current flowing through the sense device.

20. The method according to claim 19, further comprising:

providing a range selector block for setting the mirror ratio; and providing a multiplier block for generating the indication of the current flowing through the pass device by multiplying the indication of the current flowing through the sense device by the set mirror ratio.

21. The method according to claim 14, further comprising providing a first operational amplifier that receives indications of the predetermined voltage and the voltage drop across the pass device at its input ports and that controls a voltage at the control terminal of the pass device.

22. The method according to claim 21, further comprising coupling one input port of the first operational amplifier to the supply voltage level through a reference voltage source that generates the predetermined voltage, and coupling a second input port of the first operational amplifier to an output terminal of the pass device; or coupling the one input port of the first operational amplifier to the supply voltage level, and coupling the second input port of the first operational amplifier to an output terminal of the pass device through a reference voltage source that generates the predetermined voltage.

23. The method according to claim 21, further comprising:

providing a series connection of a second transistor device and a current source, and coupling the series connection between the supply voltage level and ground; and coupling one input port of the first operational amplifier to an intermediate node between the second transistor device and the current source, and coupling the other input port of the first operational amplifier to an output terminal of the pass device.

24. The method according to claim 14, further comprising providing a voltage drop equalizer for regulating the voltage drop across the sense device to the voltage drop across the pass device.

25. The method according to claim 14, further comprising:

providing a second operational amplifier and respectively coupling its input ports to an output terminal of the pass device and an output terminal of the sense device; and providing a third transistor device, coupling an input terminal of the third transistor device to the output terminal of the sense device, and coupling a control terminal of the third transistor device to an output of the second operational amplifier.

26. The method according to claim 14, wherein each of the plurality of transistor devices of the sense device corresponds to a respective slice of the sense device.

* * * * *